US008217563B2

(12) United States Patent
Shibata et al.

(10) Patent No.: US 8,217,563 B2
(45) Date of Patent: Jul. 10, 2012

(54) SPARK PLUG FOR INTERNAL COMBUSTION ENGINE AND METHOD OF MANUFACTURING THE SAME

(75) Inventors: Tsutomu Shibata, Owariasahi (JP); Keita Nakagawa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/990,803

(22) PCT Filed: Jun. 1, 2009

(86) PCT No.: PCT/JP2009/059955

§ 371 (c)(1),
(2), (4) Date: Nov. 3, 2010

(87) PCT Pub. No.: WO2009/154070

PCT Pub. Date: Dec. 23, 2009

(65) Prior Publication Data

US 2011/0133626 A1 Jun. 9, 2011

(30) Foreign Application Priority Data

Jun. 18, 2008 (JP) ..... 2008-158958

(51) Int. Cl.
*H01T 13/02* (2006.01)

(52) U.S. Cl. ..... 313/141; 313/130; 313/137; 445/7

(58) Field of Classification Search ..... 313/130, 313/137, 141; 445/7

See application file for complete search history.

(56) References Cited

U.S. PATENT DOCUMENTS

| | | | | |
|---|---|---|---|---|
| 3,088,921 | A * | 5/1963 | Heischman | 252/516 |
| 3,567,658 | A * | 3/1971 | Webb et al. | 252/506 |
| 4,173,731 | A * | 11/1979 | Takagi et al. | 315/58 |
| 5,008,584 | A | 4/1991 | Atsumi et al. | |
| 6,160,342 | A * | 12/2000 | Nishikawa et al. | 313/141 |
| 6,188,166 | B1 * | 2/2001 | Nishikawa et al. | 313/141 |
| 6,334,800 | B1 * | 1/2002 | Nishikawa et al. | 445/7 |
| 6,426,586 | B1 * | 7/2002 | Young et al. | 313/130 |

(Continued)

FOREIGN PATENT DOCUMENTS

JP 1605377 C 9/1984

(Continued)

OTHER PUBLICATIONS

International Search Report for corresponding PCT application No. PCT/JP2009/059955.

*Primary Examiner* — Peter Macchiarolo
(74) *Attorney, Agent, or Firm* — Leason Ellis LLP.

(57) ABSTRACT

A spark plug having sufficient durability for an internal combustion engine can restrain a sharp increase in resistance of a resistor in spite of its reduced size. The spark plug comprises an insulator having an axial hole, a metallic shell provided on the outer circumference of the insulator, a center electrode inserted into a front end portion of the axial hole, a terminal electrode inserted into a rear end portion of the axial hole, and a ground electrode. A circular columnar resistor is disposed within the axial hole between the center electrode and the terminal electrode, thereby electrically connecting the center electrode and the terminal electrode. The resistor is composed of carbon black that serves as a conductive material, a glass powder, and ceramic particles. Each of the ceramic particles has a maximum particle size of 0.5 μm or less.

14 Claims, 2 Drawing Sheets

U.S. PATENT DOCUMENTS

| | | | | |
|---|---|---|---|---|
| 6,559,579 | B2 * | 5/2003 | Ito et al. | 313/143 |
| 6,583,537 | B1 * | 6/2003 | Honda et al. | 313/136 |
| 7,081,274 | B2 * | 7/2006 | Nishikawa et al. | 427/376.2 |
| 7,388,323 | B2 * | 6/2008 | Shibata et al. | 313/143 |
| 2003/0051341 | A1 * | 3/2003 | Nishikawa et al. | 29/888.01 |
| 2006/0076865 | A1 * | 4/2006 | Shibata et al. | 313/143 |
| 2011/0037371 | A1 * | 2/2011 | Kuribayashi et al. | 313/134 |
| 2011/0204766 | A1 * | 8/2011 | Yoshida et al. | 313/141 |
| 2011/0248620 | A1 * | 10/2011 | Shibata et al. | 313/141 |

FOREIGN PATENT DOCUMENTS

| | | |
|---|---|---|
| JP | 9-45458 | 2/1997 |
| JP | 2800279 | 7/1998 |
| JP | 3819586 B2 | 8/1999 |
| JP | 2006-66086 | 3/2006 |
| JP | 2006-236906 | 9/2006 |

* cited by examiner

SPARK PLUG FOR INTERNAL COMBUSTION ENGINE AND METHOD OF MANUFACTURING THE SAME

CROSS-REFERENCE TO RELATED PATENT APPLICATIONS

This application is a U.S. National Phase Application under 35 U.S.C. §371 of International Patent Application No. PCT/JP2009/059955, filed Jun. 1, 2009, and claims the benefit of Japanese Patent Application No. 2008-158958, filed Jun. 18, 2008, all of which are incorporated by reference herein. The International Application was published in Japanese on Dec. 23, 2009 as International Publication No. WO/2009/154070 under PCT Article 21(2).

FIELD OF THE INVENTION

The present invention relates to a spark plug for use in an internal combustion engine and to a method of manufacturing the same.

BACKGROUND OF THE INVENTION

A spark plug for an internal combustion engine is attached to an internal combustion engine (engine) and is used to ignite an air-fuel mixture in the combustion chamber of the engine. Generally, a spark plug includes an insulator having an axial hole, a center electrode inserted into a front end portion of the axial hole, a terminal electrode inserted into a rear end portion of the axial hole, a metallic shell provided on the outer circumference of the insulator, and a ground electrode provided on the front end surface of the metallic shell and adapted to form a spark discharge gap in cooperation with the center electrode. A resistor is provided within the axial hole between the center electrode and the terminal electrode, for restraining radio noise generated in association with the operation of the engine, and electrically connects the two electrodes (refer to, for example, Japanese Patent No. 2800279).

Generally, the resistor is formed from a resistor composition composed of a conductive material, such as carbon black, and ceramic particles (e.g., glass powder). In the resistor, the conductive material is present in such a manner as to cover the surfaces of the ceramic particles; as a result, the conductive material forms a large number of conductive paths which electrically connect the two electrodes. Due to the formation of a large number of conductive paths, even when some conductive paths are damaged by oxidation or the like induced by an electrical load, a sharp increase in resistance can be effectively restrained.

Meanwhile, in recent years, a reduction in size (a reduction in diameter) has been required for spark plugs. In order to reduce the size (diameter) of a spark plug, a reduction in the wall thickness of the insulator may be considered. However, a mere reduction in the wall thickness of the insulator may accompany deterioration in withstand voltage and mechanical strength. Thus, in order to reduce the size of a spark plug while preserving a certain thickness of the wall, a reduction in the diameter of the axial hole in which the resistor is disposed may be considered.

However, as the diameter of the axial hole decreases, the outer diameter of the resistor to be disposed within the axial hole also decreases. As a result, in the resistor, an electrical load per unit area increases, which is more likely to cause the losses of conductive paths. Since the reduction in diameter accompanies a reduction in the number of conductive paths in the resistor, even if a relatively small number of conductive paths are lost, resistance may increase sharply. That is, if the size of a spark plug is merely reduced without taking any measures, it may lead to the failure of spark discharge (i.e., misfire) at a relatively early stage.

SUMMARY OF THE INVENTION

The present invention has been achieved in view of the above circumstances, and an object of the invention is to provide a spark plug for an internal combustion engine which, even when the size (diameter) thereof is reduced, can restrain a sharp increase in resistance of a resistor while maintaining sufficient durability, as well as a method of manufacturing the same.

Configurations suited for achieving the above-mentioned object will be described individually as follows. If necessary, specific functional features corresponding to configurations will be described.

Configuration 1: A spark plug for an internal combustion engine according to the present configuration comprises: a tubular insulator having an axial hole extending therethrough in a direction of an axis;

a center electrode inserted into one end portion of the axial hole;

a terminal electrode inserted into another end portion of the axial hole;

a tubular metallic shell provided on an outer circumference of the insulator; and a resistor provided within the axial hole and electrically connecting the center electrode and the terminal electrode; and the spark plug is characterized in that:

the resistor is formed from a resistor composition mainly composed of a conductive material, a glass powder, and ceramic particles, and the ceramic particles have a maximum particle size of 0.5 or less.

Examples of "ceramic particles" include particles of zirconium oxide ($ZrO_2$), titanium oxide ($TiO_2$), aluminum oxide ($Al_2O_3$), and silicon dioxide ($SiO_2$). $SiO_2$ is a main component of "glass"; however, the glass powder of the present configuration has a relatively large particle size as compared with the ceramic particles. That is, when $SiO_2$ particles are used as the ceramic particles, the $SiO_2$ particles are $SiO_2$ crystals or the like which are smaller in particle size than the glass powder.

According to the above-mentioned configuration 1, the ceramic particles have a maximum particle size of 0.5 μm or less; thus, the surface area of the ceramic particles per unit volume of the resistor can be increased. Accordingly, the number of conductive paths per unit volume can be increased. Thus, even when some conductive paths are lost due to oxidation or the like caused by prolonged use, a sharp increase in resistance can be restrained. As a result, the durability of a spark plug can be improved drastically. Even when the size (diameter) of a spark plug is reduced, durability is by no means inferior to that of a spark plug with an unreduced size.

In order to form as many conductive paths as possible, it is preferable to have ceramic particles whose maximum particle size is smaller. Therefore, the maximum particle size of the ceramic particles is preferably 0.3 μm or less, more preferably 0.1 μm or less.

An increase in the surface area of the ceramic particles per unit volume of the resistor accompanies an increase in the resistance of the resistor. Thus, in order for the resistor to have a predetermined resistance (e.g., 1 kΩ-10 kΩ), it is preferable to have the content of the conductive material in a range of 0.2 wt. % or more to 1.5 wt. % or less.

Configuration 2: A spark plug for an internal combustion engine according to the present configuration is characterized in that, in the above-mentioned configuration 1, the resistor composition is prepared through mixing in the ceramic particles in a sol state.

As mentioned above, the smaller the maximum particle size of the ceramic particles, the more durability improves. However, it is relatively difficult to uniformly disperse particles with a smaller particle size. Thus, those smaller ceramic particles tend to fail to be uniformly dispersed in the resistor; as a result, functional features of the above-mentioned configuration 1 may not be sufficiently realized.

In this regard, according to the above-mentioned configuration 2, the resistor composition is prepared through mixing the ceramic particles in a sol state (the "sol state" means dispersion in a dispersion medium, such as water). Thus, the ceramic particles can be dispersed more uniformly in the resistor composition, and in turn a larger number of conductive paths can be formed in the resistor. As a result, durability can be further improved, and service life can be elongated drastically. The resistor composition may also be prepared as follows: a conductive material and a glass powder are wet-prepared by use of a dispersion medium, such as water, and the ceramic particles in a sol state are mixed with the wet-prepared mixture.

Configuration 3: A spark plug for an internal combustion engine according to the present configuration is characterized in that, in the above-mentioned configuration 1 or 2, the ceramic particles contain particles of at least one of $ZrO_2$ and $TiO_2$.

According to the above-mentioned configuration 3, the ceramic particles contain particles of at least one of $ZrO_2$ and $TiO_2$. Thus, as compared with the case where $Al_2O_3$ particles, $SiO_2$ particles, or the like are used as the ceramic particles, durability can be further improved.

Using $ZrO_2$ particles or $TiO_2$ particles is believed to improve durability based on the following reason. When high voltage is applied, $ZrO_2$ particles and $TiO_2$ particles can carry current even though the current is very weak. As a result, the electrical load imposed on the conductive paths can be mitigated.

Configuration 4: A spark plug for an internal combustion engine according to the present configuration is characterized in that, in any one of the above-mentioned configurations 1 to 3, the resistor has a circular columnar shape and an outer diameter of 2.9 mm or less.

When the outer diameter of the resistor is reduced to a relatively small size of 2.9 mm or less as in the case of the above-mentioned configuration 4, resistance tends to increase sharply due to an increase in electrical load and a reduction in conductive paths. Thus, spark plug misfire may occur even if it is used for only a very short period of time. However, by using the above-mentioned configuration 1, etc., such a problem of misfire can be avoided. In other words, the above-mentioned configurations are particularly effective for a spark plug in which the outer diameter of the resistor is reduced to a relatively small size of 2.9 mm or less.

The above-mentioned spark plug for an internal combustion engine can be manufactured by the following method.

Configuration 5: A method of manufacturing a spark plug for an internal combustion engine according to the present configuration comprising:

a tubular insulator having an axial hole extending therethrough in a direction of an axis;

a center electrode inserted into one end portion of the axial hole;

a terminal electrode inserted into the other end portion of the axial hole;

a tubular metallic shell provided on an outer circumference of the insulator; and a circular columnar resistor provided within the axial hole and electrically connecting the center electrode and the terminal electrode; and the method comprising:

a preparation step of preparing a resistor composition mainly composed of a conductive material, a glass powder, and ceramic particles having a maximum particle size of 0.5 μm or less, and used to form the resistor, and a firing step of charging the resistor composition into the axial hole of a green insulator and firing the resultant green insulator for forming the resistor.

According to the above-mentioned configuration 5, the ceramic particles contained in the resistor yielded through the firing step have a maximum particle size of 0.5 μm or less. Thus, the number of conductive paths formed per unit volume of the resistor can be increased. Because of this, even when some conductive paths are damaged by oxidation or the like-caused by a prolonged use, a sharp increase in resistance can be restrained. As a result, the durability of a spark plug can be improved drastically. Even when the diameter of the axial hole of the insulator is reduced in association with a reduction in the size (diameter) of a spark plug, durability is by no means inferior to that of a spark plug in which the diameter of the axial hole of the resistor is unreduced.

Configuration 6: A method of manufacturing a spark plug for an internal combustion engine according to the present configuration is characterized in that, in the above-mentioned configuration 5, in the preparation step, the ceramic particles in a sol state are mixed in for preparation of the resistor composition.

According to the above-mentioned configuration 6, in preparation of the resistor composition, the ceramic particles are mixed in a sol state. Thus, the ceramic particles can be dispersed more uniformly in the resistor composition. As a result, a larger number of conductive paths can be formed in the resistor, whereby durability can be further improved.

Configuration 7: A method of manufacturing a spark plug for an internal combustion engine according to the present configuration is characterized in that, in the above-mentioned configuration 5 or 6, a portion of the axial hole in which the resistor is provided has a diameter of 2.9 mm or less as measured after the firing step.

In a spark plug having the insulator configured such that a portion of the axial hole in which the resistor is provided is reduced in diameter to a relatively small size of 2.9 mm or less as in the case of the above-mentioned configuration 7, the outer diameter of the resistor is also reduced to a relatively small size. Accordingly, resistance tends to increase sharply due to an increase in electrical load and a reduction in conductive paths. Thus, misfire may occur even if the spark plug were used for a very short period of time.

In this regard, by using the above-mentioned configuration 5, etc., such a problem of misfire can be avoided. That is, when manufacturing a spark plug having the insulator whose axial hole is reduced in diameter to a relatively small size, the manufacturing method according to the above-mentioned configuration 5, etc. can provide a spark plug with sufficient durability.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE PREFERRED EMBODIMENTS

Figure 1:
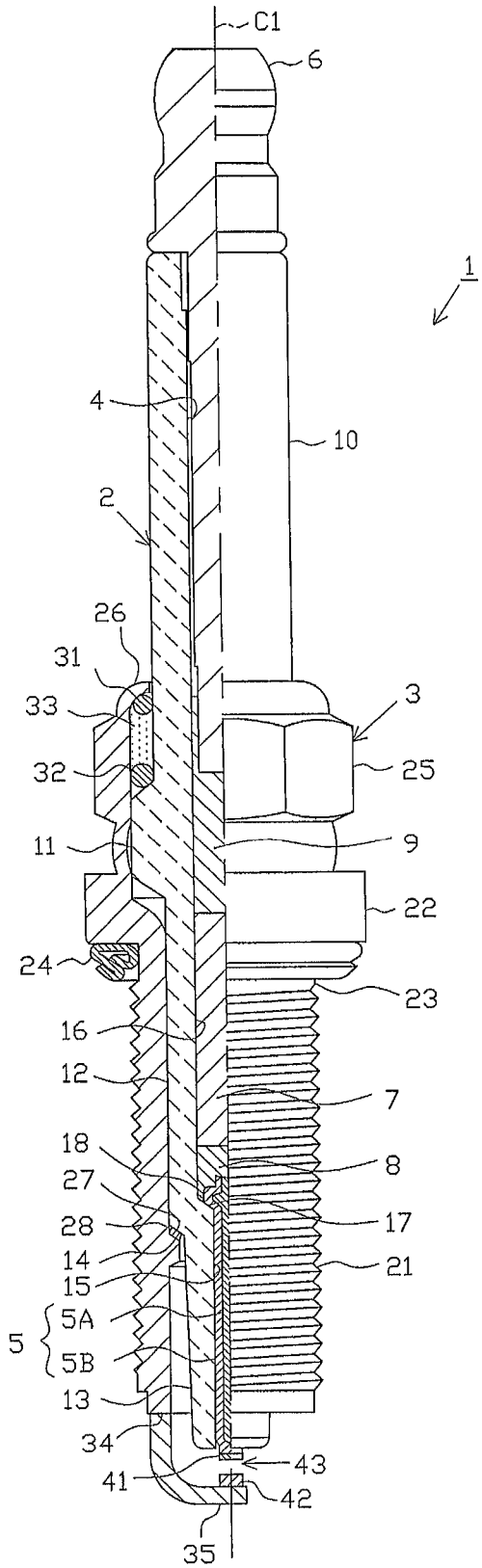
FIG. 1 is a partially cutaway front view showing a spark plug according to the present embodiment.

An embodiment of the present invention will be described with reference to the drawings. FIG. 1 is a partially cutaway front view showing a spark plug for an internal combustion engine (hereinafter referred to as the "spark plug") 1. In the following description, the direction of an axis C1 of the spark plug 1 in FIG. 1 is referred to as the vertical direction, and the lower side of the spark plug 1 in FIG. 1 is referred to as the front side of the spark plug 1, and the upper side as the rear side of the spark plug 1.

The spark plug 1 includes an insulator 2, which serves as a tubular insulator, and a tubular metallic shell 3, which holds the insulator 2.

The insulator 2 is formed from alumina or the like by firing, as is well known in the art. The insulator 2 externally includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. The large-diameter portion 11, the intermediate trunk portion 12, and most of the leg portion 13 of the insulator 2 are accommodated in the metallic shell 3. A tapered, stepped portion 14 is formed at a connection portion between the leg portion 13 and the intermediate trunk portion 12. The insulator 2 is seated on the metallic shell 3 via the stepped portion 14.

The insulator 2 has an axial hole 4 extending therethrough along the axis C1. The axial hole 4 has a small-diameter portion 15 formed at a front end portion thereof, and a large-diameter portion 16, which is located rearward of the small-diameter portion 15 and is greater in diameter than the small-diameter portion 15. A tapered, stepped portion 17 is formed between the small-diameter portion 15 and the large-diameter portion 16.

In the present embodiment, in order to reduce the size (diameter) of the spark plug 1, the diameter of the insulator 2 is reduced. Accordingly, the axial hole 4 is also reduced in diameter. As a result, a diameter of 2.9 mm or less (e.g., 2.5 mm) is imparted to the large-diameter portion 16.

Additionally, a center electrode 5 is fixedly inserted into a front end portion (small-diameter portion 15) of the axial hole 4. More specifically, the center electrode 5 has an expanded portion 18 formed at a rear end portion thereof and expanding in a direction toward the outer circumference thereof. The center electrode 5 is fixed in a state in which the expanded portion 18 is seated on the stepped portion 17 of the axial hole 4. The center electrode 5 includes an inner layer 5A of copper or a copper alloy, and an outer layer 5B of a Ni alloy which contains nickel (Ni) as a main component. Further, the center electrode 5 assumes a rodlike (circular columnar) shape as a whole; has a flat front end surface; and projects from the front end of the insulator 2.

A terminal electrode 6 is fixedly inserted into the rear side (large-diameter portion 16) of the axial hole 4 so that the terminal electrode 6 projects from the rear end of the insulator 2.

Further, a circular columnar resistor 7 is disposed within the axial hole 4 (large-diameter portion 16) between the center electrode 5 and the terminal electrode 6 (the resistor 7 will be described in detail later). Opposite end portions of the resistor 7 are electrically connected to the center electrode 5 and the terminal electrode 6 via conductive glass seal layers 8 and 9, respectively.

Additionally, the metallic shell 3 is formed from a low-carbon steel or the like and is formed into a tubular shape. The metallic shell 3 has a threaded portion (externally threaded portion) 21 on its outer circumferential surface, and the threaded portion 21 is used to attach the spark plug 1 to an engine head. The metallic shell 3 has a seat portion 22 formed on its outer circumferential surface and located rearward of the threaded portion 21. A ring-like gasket 24 is fitted to a screw neck 23 located at the rear end of the threaded portion 21. The metallic shell 3 also has a tool engagement portion 25 provided near its rear end. The tool engagement portion 25 has a hexagonal cross section and allows a tool such as a wrench to be engaged therewith when the metallic shell 3 is to be attached to the engine head. Further, the metallic shell 3 has a crimp portion 26 provided at its rear end portion and adapted to hold the insulator 2.

The metallic shell 3 has a tapered, stepped portion 27 provided on its inner circumferential surface and adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 27 of the metallic shell 3, a rear-end opening portion of the metallic shell 3 is crimped radially inward; i.e., the crimp portion 26 is formed, whereby the insulator 2 is fixed in place. An annular sheet packing 28 intervenes between the stepped portions 14 and 27 of the insulator 2 and the metallic shell 3, respectively. This retains gastightness of a combustion chamber and prevents leakage of an air-fuel mixture to the exterior of the spark plug 1 through a clearance between the inner circumferential surface of the metallic shell 3 and the leg portion 13 of the insulator 2, which leg portion 13 is exposed to the combustion chamber.

Further, in order to ensure gastightness which is established by crimping, annular ring members 31 and 32 intervene between the metallic shell 3 and the insulator 2 in a region near the rear end of the metallic shell 3, and a space between the ring members 31 and 32 is filled with a powder of talc 33. That is, the metallic shell 3 holds the insulator 2 via the sheet packing 28, the ring members 31 and 32, and the talc 33.

Also, a ground electrode 35 formed from a nickel (Ni) alloy is joined to a front end surface 34 of the metallic shell 3. Specifically, a proximal end portion of the ground electrode 35 is welded to the front end surface 34 of the metallic shell 3, and a portion of the ground electrode 35 located on a side toward the distal end of the ground electrode 35 is bent such that a side surface of the portion faces a front end portion of the center electrode 5.

Additionally, a circular columnar noble-metal chip 41 formed from a noble metal alloy (e.g., a platinum alloy, an iridium alloy, or the like) is joined to the front end surface of the center electrode 5. Also, a circular columnar noble-metal chip 42 is joined to a surface of the ground electrode 35 which faces the noble-metal chip 41. A spark discharge gap 43 is formed between a distal end portion of the noble-metal chip 41 and a distal end portion of the noble-metal chip 42.

Figure 2:
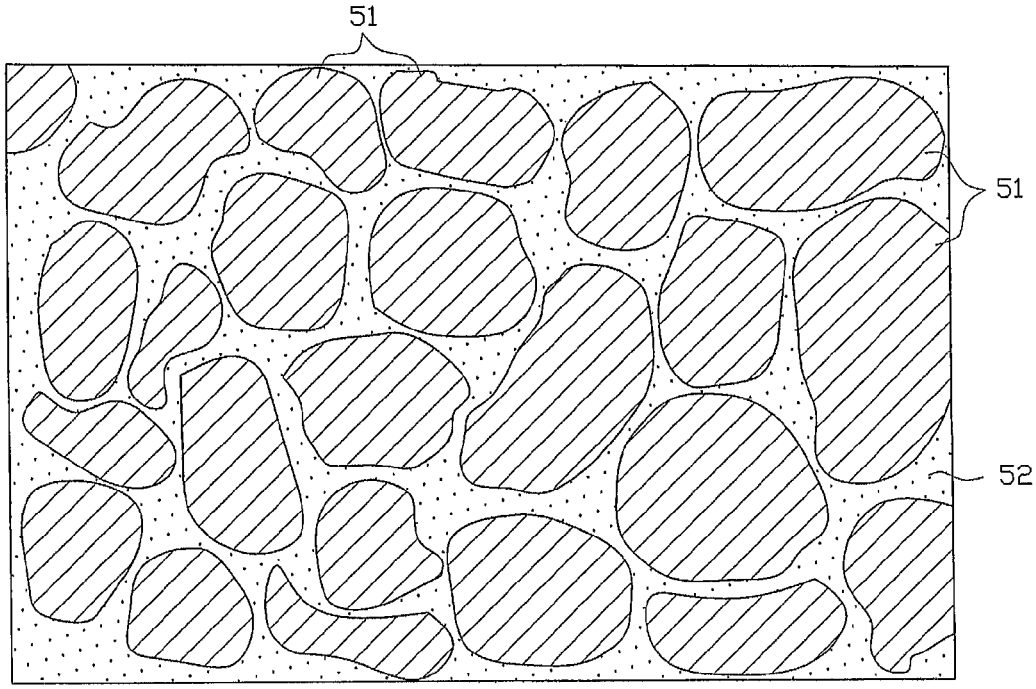
FIG. 2 is a schematic view showing a resistor according to the present embodiment.

Next, the resistor 7, which is a feature of the present invention, is described. In the present embodiment, as shown in FIG. 2, the resistor 7 is composed of a glass powder 51 and a conductive path formation region 52, which is present in such a manner as to cover the glass powder 51. The glass powder 51 has, among others, a role in bonding the resistor 7 to the glass seal layers 8 and 9 in a dense state by undergoing a heating process, which will be described later.

Figure 3:
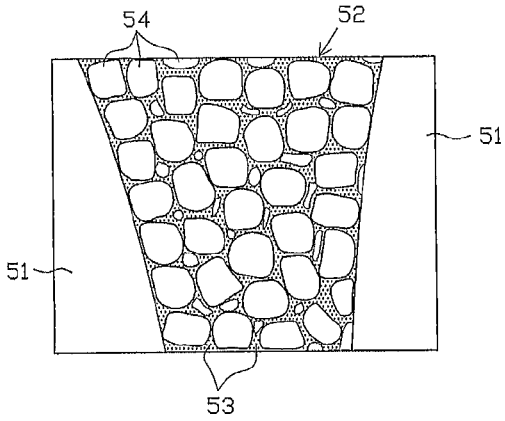
FIG. 3 is a schematic view showing ceramic particles, etc. according to the present embodiment.

As shown in FIG. 3, the conductive path formation region 52 is composed of carbon black 53, which serves as a conductive material, and ceramic particles [e.g., zirconium oxide ($ZrO_2$) particles or titanium oxide ($TiO_2$) particles] 54. The ceramic particles 54 are microparticulated such that the maximum particle size is 0.5 μm or less (e.g., 0.4 μm or less). The carbon black 53 adheringly covers the surfaces of the glass powder 51 and the ceramic particles 54 contained in the resistor 7, thereby forming a large number of conductive paths in regions between the glass powder 51 and the ceramic particles 54.

Further, since, as mentioned above, the large-diameter portion 16 has a diameter of 2.9 mm or less, the resistor 7 disposed within the large-diameter portion 16 has an outer diameter of 2.9 mm or less (e.g., 2.5 mm).

Next, a method of manufacturing the spark plug 1 configured as mentioned above is described. First, the metallic shell 3 is formed beforehand. Specifically, a circular columnar metal material (e.g., an iron-based material, such as S17C or S25C, or a stainless steel material) is subjected to cold forging so as to form a through hole, thereby forming a general shape. Subsequently, machining is conducted so as to adjust the outline, thereby yielding a metallic-shell intermediate.

Then, the ground electrode 35 formed from a Ni alloy (e.g., an INCONEL alloy) is resistance-welded to the front end surface of the metallic-shell intermediate. The resistance welding accompanies the formation of so-called "sags." After the "sags" are removed, the threaded portion 21 is formed in a predetermined region of the metallic-shell intermediate by rolling. Thus, the metallic shell 3 to which the ground electrode 35 is welded is obtained. The metallic shell 3 to which the ground electrode 35 is welded is subjected to galvanization or nickel plating. In order to enhance corrosion resistance, the plated surface may be further subjected to chromate treatment.

Further, the above-mentioned noble-metal chip 42 is joined to a distal end portion of the ground electrode 35 by resistance welding, laser welding, or the like. For more reliable welding, plating is removed from a welding region prior to the welding, or plating is performed with a welding region masked. Also, the noble-metal chip 42 may be welded after an assembling process to be described later.

Separately from the metallic shell 3, the insulator 2 may be formed. For example, a forming material granular-substance is prepared by use of a material powder which contains alumina in a predominant amount, a binder, etc. By use of the prepared granular substance, a tubular green compact is formed by rubber press forming. The thus-formed green compact is subjected to grinding for shaping. The shaped green compact is placed in a kiln, followed by firing (firing step). Thus, the insulator 2 is obtained.

Also, separately from preparation of the metallic shell 3 and the insulator 2, the center electrode 5 is formed. Specifically, a Ni alloy is subjected to forging, and the inner layer 5A formed from a copper alloy is disposed in a central portion of the forged Ni alloy for the purpose of enhancing heat radiation. The above-mentioned noble-metal chip 41 is joined to a front end portion of the center electrode 5 by resistance welding, laser welding, or the like.

Further, a powdery resistor composition used to form the resistor 7 is prepared (preparation step). Specifically, first, the carbon black 53, the ceramic particles 54 whose maximum particle size is 0.5 μm or less and which are brought into a sol state by use of water as a dispersion medium, and a binder are prepared and then mixed together by use of water as a medium. The resultant slurry is dried. The resultant dried substance and the glass powder 51 are mixed by stirring, thereby yielding a resistor composition. In the present embodiment, the resistor composition contains the glass powder 51 in an amount of 70 wt. % to 90 wt. % inclusive (e.g., 80 wt. %), the carbon black 53 in an amount of 0.2 wt. % to 1.5 wt. % inclusive (e.g., 0.6 wt. %), a binder in an amount of 0.5 wt. % to 5.5 wt. % inclusive (e.g., 2 wt. %), and a balance of the ceramic particles 54. In place of the ceramic particles 54 in a sol state, the ceramic particles 54 in a powdery state may be used in the formation of the resistor composition.

The insulator 2 and the center electrode 5, which are formed as mentioned above, the resistor 7, and the terminal electrode 6 are fixed in a sealed condition by means of the glass seal layers 8 and 9. More specifically, first, the center electrode 5 is inserted into the small-diameter portion 15 of the axial hole 4. At this time, the expanded portion 18 of the center electrode 5 is seated on the stepped portion 17 of the axial hole 4. Next, a conductive glass powder, which is generally prepared by mixing borosilicate glass and a metal powder, is charged into the axial hole 4. The charged conductive glass powder is subjected to preliminary compression. Next, the resistor composition is charged into the axial hole 4, followed by similar preliminary compression. Further, the conductive glass powder is charged, followed also by preliminary compression. Subsequently, in a state in which the terminal electrode 6 is pressed into the axial hole 4 from a side opposite the center electrode 5, the resultant assembly is heated in a kiln at a predetermined temperature (in the present embodiment, 800° C. to 950° C.) higher than the softening point of glass. By this procedure, the resistor composition and the conductive glass powder in a stacked condition are compressed and sintered, thereby yielding the resistor 7 and the glass seal layers 8 and 9. Also, the insulator 2 and the center electrode 5, the resistor 7, and the terminal electrode 6 are fixed in a sealed condition by means of the glass seal layers 8 and 9. In this heating process within the kiln, a glazed trunk portion of the insulator 2 located on a side toward the rear end of the insulator 2 may be simultaneously fired so as to form a glaze layer; alternatively, the glaze layer may be formed beforehand.

Subsequently, the thus-formed insulator 2 having the center electrode 5, the resistor 7, etc., and the metallic shell 3 having the ground electrode 35 are assembled together. More specifically, a relatively thin-walled rear-end opening portion of the metallic shell 3 is crimped radially inward; i.e., the above-mentioned crimp portion 26 is formed, thereby fixing the insulator 2 and the metallic shell 3 together.

Finally, the ground electrode 35 is bent so as to form the spark discharge gap 43 between the noble-metal chip 41 provided on the front end of the center electrode 5 and the noble-metal chip 42 provided on the ground electrode 35.

Through a series of steps mentioned above, the spark plug 1 having the above-mentioned configuration is manufactured.

Next, in order to verify features and effects attained by the present embodiment, a life under load evaluation test was conducted. The outline of the life under load evaluation test is as follows. Spark plug samples were fabricated while varying the particle size (maximum particle size and average particle size) of the ceramic particles, the type of the ceramic particles, the outer diameter of the resistor (2.9 mm or 2.5 mm), and the state of the ceramic particles in preparation of the resistor composition (powder state or sol state). The samples were connected to an automotive transistor igniter and caused to generate 3,600 discharges per minute with a discharge voltage of 20 kV at a temperature of 350° C. Resistance after the elapse of 100 hours and resistance after the elapse of 250 hours were measured. The evaluation "Excellent" was awarded to those samples whose resistances after the elapse of 250 hours exceeded neither the initial resistance nor respective resistances after the elapse of 100 hours, for particularly excellent durability. The evaluation "Good" was awarded to those samples whose resistances after the elapse of 250 hours exceeded respective resistances after the elapse of 100 hours, but did not exceed the initial resistance, for excellent durability. The evaluation "Failure" was awarded to those samples whose resistances after the elapse of 250 hours exceeded the initial resistance, for insufficient durability. The initial resistance of the samples was 5 kΩ. The carbon black content was adjusted as appropriate so as to impart the initial resistance to the samples. Table 1 shows the results of the life under load evaluation test. ">200 kΩ" appearing in Table 1 means that a high resistance in excess of 200 kΩ was observed. The samples were fabricated such that the same sample was fabricated in a plurality of pieces each for the above-mentioned durability evaluation test and for measurement of the particle size of the ceramic particles used to form the resistor, which will be described below.

The average particle size of the ceramic particles used to fabricate the samples is measured prior to the preparation Of the material. Specifically, the average particle size is measured by use of a laser scattering method. Meanwhile, the ceramic particles which partially constitute the resistor of a completed spark plug formed through firing are measured for particle size by use of SEM (scanning electron microscope). Specifically, the fabricated spark plug (in a state before assembly to the metallic shell) is cut perpendicularly to the axis substantially at the center of the resistor with respect to the axial direction. The section of the resistor is observed through SEM (10,000 magnification). Locations of observation are, for example, the center and four peripheral locations of the section which are evenly selected. A ceramic particle having a maximum particle size is visually found from among ceramic particles in the thus-selected five visual fields of observation. The particle size of the found ceramic particle is measured on the captured image and taken as the maximum particle size. Of course, all of the ceramic particles in the visual fields of observation may be measured for particle size, and the maximum particle size may be selected from among the measured particle sizes. The visual field of observation through SEM measures 10.1×13.5 (μm), enabling sufficient coverage of measurement over the section of the resistor without involvement of redundancy.

Table 1 shows the thus-obtained average particle sizes and maximum particle sizes.

TABLE 1

| | | Ceramic particles | | | | 0 hr | After elapse of 100 hours | | After elapse of 250 hours | | |
|---|---|---|---|---|---|---|---|---|---|---|---|
| Sample No. | Outer dia. of resistor mm | Type | State | Ave. part. size μm | Maximum part. size μm | Resistance kΩ | Resistance kΩ | Rate of change % | Resistance kΩ | Rate of change % | Evaluation |
| 1 | 2.9 | Zirconium oxide | Powder | 2 | 20 | 5 | 100 | — | >200 | — | Failure |
| 2 | 2.5 | zirconium oxide | Powder | 2 | 20 | 5 | >200 | — | >200 | — | Failure |
| 3 | 2.9 | Zirconium oxide | Powder | 1 | 10 | 5 | 4 | −20 | 6.5 | 30 | Failure |
| 4 | 2.5 | Zirconium oxide | Powder | 1 | 10 | 5 | >200 | — | >200 | — | Failure |
| 5 | 2.9 | Zirconium oxide | Powder | 0.5 | 1 | 5 | 4 | −20 | 6 | 20 | Failure |
| 6 | 2.5 | Zirconium oxide | Powder | 0.5 | 1 | 5 | >200 | — | >200 | — | Failure |
| 7 | 2.5 | Aluminum oxide | Sol | 0.1 | 0.5 | 5 | 4 | −20 | 5 | 0 | Good |
| 8 | 2.9 | Zirconium oxide | Powder | 0.1 | 0.5 | 5 | 4 | −20 | 4 | −20 | Excellent |
| 9 | 2.9 | Titanium oxide | Powder | 0.1 | 0.5 | 5 | 4 | −20 | 4 | −20 | Excellent |
| 10 | 2.5 | Zirconium oxide | Powder | 0.1 | 0.5 | 5 | 4 | −20 | 4.5 | −10 | Good |
| 11 | 2.9 | Zirconium oxide | Sol | 0.1 | 0.5 | 5 | 4 | −20 | 4 | −20 | Excellent |
| 12 | 2.9 | Titanium oxide | Sol | 0.1 | 0.5 | 5 | 4 | −20 | 4 | −20 | Excellent |
| 13 | 2.9 | Zirconium oxide | Sol | 0.1 | 0.4 | 5 | 4 | −20 | 4 | −20 | Excellent |
| 14 | 2.9 | Zirconium oxide | Sol | 0.1 | 0.3 | 5 | 4 | −20 | 4 | −20 | Excellent |
| 15 | 2.5 | Zirconium oxide | Sol | 0.1 | 0.5 | 5 | 4 | −20 | 4 | −20 | Excellent |
| 16 | 2.5 | Zirconium oxide | Sol | 0.1 | 0.4 | 5 | 4 | −20 | 4 | −20 | Excellent |
| 17 | 2.5 | Zirconium oxide | Sol | 0.1 | 0.3 | 5 | 4 | −20 | 4 | −20 | Excellent |
| 18 | 2.9 | Zirconium oxide and titanium oxide | Sol | 0.1 | 0.5 | 5 | 4 | −20 | 4 | −20 | Excellent |

As shown in Table 1, in the samples whose maximum particle sizes of the ceramic particles exceed 0.5 μm (Samples 1, 2, 3, 4, 5, and 6), respective resistances after the elapse of 250 hours exceed the initial resistance. A conceivable reason for this is as follows: since the outer diameter of the resistor is reduced to a relatively small size (2.9 mm or less), when even some conductive paths are damaged by oxidation or the like, the number of conductive paths in the resistor is reduced to such an extent as to sharply increase resistance.

By contrast, in the samples whose maximum particle sizes of the ceramic particles are equal to or less than 0.5 μm (Samples 7, 8, 9, 10, 11, 12, 13, 14, 15, 16, and 17), respective resistances after the elapse of 250 hours do not exceed the initial resistance, indicating excellent durability. A conceivable reason for this is as follows: the outer diameter of the resistor is reduced to a relatively small size of 2.9 mm or less, so that an increase in electrical load and a reduction in conductive paths are likely to arise; however, the employment of a maximum particle size of 0.5 μm or less enables the formation of a large number of conductive paths.

In comparison between the sample which uses aluminum oxide ($Al_2O_3$) as the ceramic particles (Sample 7) and the samples which use $TiO_2$ and/or $ZrO_2$ particles as the ceramic particles (Samples 8 to 18), while the samples exhibit the same resistance after the elapse of 100 hours, those samples which use $TiO_2$ and/or $ZrO_2$ particles as the ceramic particles are lower in resistance after the elapse of 250 hours (i.e., an increase in resistance is restrained with the samples). A conceivable reason for this is as follows: when high voltage is applied, $ZrO_2$ particles and $TiO_2$ particles can carry current even though the current is very weak, thereby mitigating electrical load imposed on the conductive paths.

When the samples identical in parameters other than the outer diameter of the resistor (e.g., Samples 3, 4, etc.) are compared in order to examine the relationship between the outer diameter of the resistor and the amount of increase in resistance, the samples having an outer diameter of the resistor of 2.5 mm (Samples 2, 4, 6, etc.) are more likely to increase in resistance than are the samples having an outer diameter of the resistor of 2.9 mm (Samples 1, 3, 5, etc.). A conceivable reason for this is as follows: a reduction in the outer diameter of the resistor reduces the space where conductive paths can be formed.

By contrast, in the case of the samples which use $TiO_2$ and/or $ZrO_2$ particles as the ceramic particles and in which the ceramic particles have a maximum particle size of 0.5 μm or less and are in a sol state at the time of the formation of a resistor composition (Samples 11 to 18), even though the outer diameter of the resistor is a relatively small size of 2.5 mm (Samples 16 to 18), particularly excellent durability is exhibited. A conceivable reason for this is as follows: the formation of a resistor composition by use of the ceramic particles in a sol state enhances the dispersibility of the ceramic particles in the resistor composition, whereby a larger number of conductive paths can be formed in the resistor.

In the life under load evaluation test, the resistance reduced for the following conceivable reason. As a result of the progress of the conduction of electricity to some extent, the state of contact among carbon black particles was stabilized, whereby the conductive performance of conductive paths was somewhat improved. However, after the stabilization of the state of contact among the carbon black particles, as mentioned above, oxidation or the like in association with the imposition of an electrical load causes the progress of damage to the conductive paths, so that the resistance increases.

The present invention is not limited to the above-described embodiment, but may be embodied, for example, as follows. Of course, application examples and modifications other than those described below are also possible.

(a) According to the above-described embodiment, the maximum particle size of the ceramic particles 54 is 0.5 μm or less. In order to form a large number of conductive paths, it is preferable that the ceramic particles 54 have a maximum particle size that is smaller. Thus, the maximum particle size of the ceramic particles 54 is preferably 0.3 μm or less, more preferably 0.1 μm or less.

(b) According to the above-described embodiment, the diameter of the large-diameter portion 16 and the outer diameter of the resistor 7 are 2.9 mm or less. However, the diameter of the large-diameter portion 16 and the outer diameter of the resistor 7 may be greater than 2.9 mm. Even in this case, by imparting a maximum particle size of 0.5 μm or less to the ceramic particles 54, the above-mentioned actions and effects are yielded, whereby excellent durability can be achieved.

(c) According to the above-described embodiment, the noble-metal chip 41 is provided on a front end portion of the center electrode 5, and the noble-metal chip 42 is provided on a distal end portion of the ground electrode 35. However, one of the noble-metal chips may be eliminated. Alternatively, both of the noble-metal chips 41 and 42 may be eliminated.

(d) According to the above-described embodiment, $ZrO_2$ particles or $TiO_2$ particles are used as the ceramic particles 54. However, other ceramic particles may be used. For example, aluminum oxide ($Al_2O_3$) particles, silicon dioxide ($SiO_2$) particles, or the like may be used, or a mixture thereof (refer to Sample 18 in Table 1) may be used. Also, a mixture of ceramic particles in a sol state and ceramic particles in a powder state may be used. In this case, needless to say, the ceramic particles may be of the same material or of different materials.

(e) According to the above-described embodiment, the ground electrode 35 is joined to the front end of the metallic shell 3. However, a portion of the metallic shell (or a portion of a front-end metal piece welded beforehand to the metallic shell) may be cut so as to form the ground electrode (e.g., Japanese Patent Application Laid-Open (kokai) No. 2006-236906).

(f) According to the above-described embodiment, the tool engagement portion 25 has a hexagonal section. However, the shape of the tool engagement portion 25 is not limited thereto. For example, the tool engagement portion 25 may have a Bi-HEX (modified dodecagonal) shape [ISO22977:2005(E)] or the like.

In the aforementioned test, the resistors have an initial resistance of 5 kΩ. However, in the present invention, the initial resistance of the resistor is not limited thereto. (In the aforementioned test, the initial resistance was set to 5 kΩ, merely because it is a general practice for spark plugs.) Thus, the resistance may be set to a value of 1 kΩ to 20 kΩ as need, but it is not to be construed as limiting.

DESCRIPTION OF REFERENCE NUMERALS

1: spark plug for internal combustion engine; 2: insulator; 3: metallic shell; 4: axial hole; 5: center electrode; 6: terminal electrode; 7: resistor; 51: glass powder; 53 carbon black serving as conductive material; 54: ceramic particles; and C1: axis.

The invention claimed is:

1. A spark plug for an internal combustion engine comprising:

a tubular insulator having an axial hole extending therethrough in a direction of an axis;

a center electrode inserted into one end portion of the axial hole;

a terminal electrode inserted into another end portion of the axial hole;

a tubular metallic shell provided on an outer circumference of the insulator; and a resistor provided within the axial hole and electrically connecting the center electrode and the terminal electrode;

wherein the resistor is formed from a resistor composition mainly composed of a conductive material, a glass powder, and ceramic particles, and the ceramic particles have a maximum particle size of 0.5 μm or less.

2. The spark plug for an internal combustion engine according to claim 1, wherein, the resistor composition is prepared by mixing in the ceramic particles in a sol state.

3. The spark plug for an internal combustion engine according to claim 1, wherein the ceramic particles contain particles of at least one of zirconium oxide and titanium oxide.

4. The spark plug for an internal combustion engine according to claim 1, wherein the resistor has a circular columnar shape and an outer diameter of 2.9 mm or less.

5. A method of manufacturing a spark plug for an internal combustion engine comprising the steps of:

providing a tubular insulator system having an axial hole extending therethrough;

preparing a resistor composition mainly composed of a conductive material, a glass powder, and ceramic particles having a maximum particle size of 0.5 μm or less to form a resistor;

charging the resistor composition into the axial hole of the green insulator;

firing the resultant green insulator to form the resistor;

inserting a center electrode into one end portion of the axial hole in electrical contact with one side of the resistor;

inserting a terminal electrode-into another end portion of the axial hole in electrical contact with the other side of the resistor; and providing a tubular metallic shell on an outer circumference of the insulator.

6. The method of manufacturing a spark plug for an internal combustion engine according to claim 5, wherein the ceramic particles in a sol state are mixed with the conductive material and a binder for the preparation of the resistor composition.

7. The method of manufacturing a spark plug for an internal combustion engine according to claim 5, wherein a portion of the axial hole in which the resistor is provided has a diameter of 2.9 mm or less as measured after-firing the green insulator.

8. The spark plug for an internal combustion engine according to claim 2, wherein the ceramic particles contain particles of at least one of zirconium oxide and titanium oxide.

9. The spark plug for an internal combustion engine according claim 2, wherein the resistor has a circular columnar shape and an outer diameter of 2.9 mm or less.

10. The spark plug for an internal combustion engine according claim 3, wherein the resistor has a circular columnar shape and an outer diameter of 2.9 mm or less.

11. The method of manufacturing a spark plug for an internal combustion engine according to claim 6, wherein a portion of the axial hole in which the resistor is provided has a diameter of 2.9 mm or less as measured after firing the green insulator.

12. The method of manufacturing a spark plug for an internal combustion engine according to claim 5, further comprising a step of wet-preparing the conductive material and the glass powder by using a dispersion medium.

13. The method of manufacturing a spark plug for an internal combustion engine according to claim 12, wherein the dispersion medium is water.

14. The spark plug for an internal combustion engine according claim 1, wherein the resistor contains the glass powder in a range of 70-90 wt. %, the conductive material in a range of 0.2-1.5 wt. %, a binder in a range of 0.5-5.5 wt. % and a balance of the ceramic particles.

* * * * *